United States Patent [19]

Hemminger et al.

[11] Patent Number: 4,806,218

[45] Date of Patent: Feb. 21, 1989

[54] METHOD OF COATING CATHODE WIRES BY CATAPHORETIC COATING

[75] Inventors: Herbert Hemminger; Michael Schlipf, both of Schorndorf, Fed. Rep. of Germany

[73] Assignee: Nokia Graetz GmbH, Pforzheim, Fed. Rep. of Germany

[21] Appl. No.: 93,406

[22] Filed: Sep. 4, 1987

[30] Foreign Application Priority Data

Sep. 5, 1986 [DE] Fed. Rep. of Germany ..... 3630224

[51] Int. Cl.[4] ..... C25D 13/02; C25D 13/16; C25D 13/18; C25D 13/20

[52] U.S. Cl. ..... 204/180.2; 204/180.9; 204/181.5; 204/181.7

[58] Field of Search ..... 204/180.2, 180.4, 180.5, 204/180.9, 181.4, 181.5, 181.7, 299 EC

[56] References Cited

U.S. PATENT DOCUMENTS

| | | | |
|---|---|---|---|
| 4,026,780 | 5/1977 | Gange | 204/181.5 |
| 4,100,449 | 7/1978 | Gange | 427/77 |
| 4,252,630 | 2/1981 | van den Huevel | 204/299 EC |
| 4,302,309 | 11/1981 | van den Heuvel | 204/180.2 |
| 4,487,673 | 12/1984 | Steinmetz | 204/181.5 |

*Primary Examiner*—John F. Niebling
*Assistant Examiner*—Ben C. Hsing
*Attorney, Agent, or Firm*—Peter C. Van Der Sluys

[57] ABSTRACT

Oxide cathode wires are produced by coating tungsten wires with emissive material by cataphoretic coating. It is important for the coating to have a substantially uniform thickness over the entire surface of the wire. This is achieved in a simple manner by reversing the polarity of the direction of current flow for a short time at the beginning of the coating process, so that the tungsten wire to be coated is connected as an anode. The remainder of the coating process is performed in a known manner with a tungsten wire connected as a cathode.

12 Claims, 1 Drawing Sheet

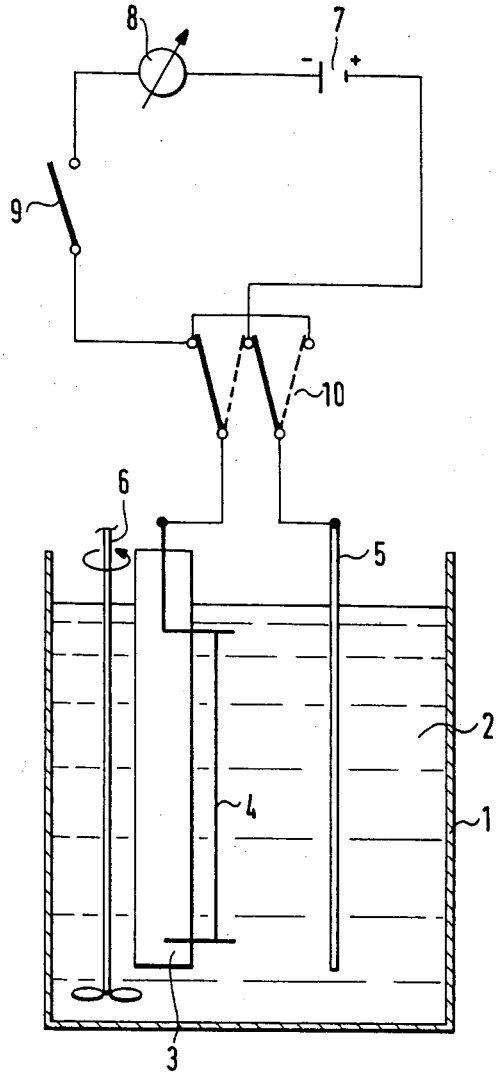
8
7
-
+
9
10
6
5
2
4
1
3

METHOD OF COATING CATHODE WIRES BY CATAPHORETIC COATING

BACKGROUND OF THE INVENTION

1. Field of the Invention

The present invention relates to a method of coating cathode wires by cataphoretically coating wires with an emissive material.

2. Description of the Prior Art

A method of coating cathode wires by cataphoretically coating wires with an emissive material is known from DE-OS No. 27 15 242 which corresponds to U.S. Pat. No. 4,100,449.

In directly heated oxide cathodes, wires are used which are generally made of tungsten and are coated with an emissive material. Since the oxide cathode temperature and, thus, the emittance must be maintained very precisely over the entire length, coated oxide cathode wires are required which have a substantially uniform diameter over their entire length. To that end, tungsten wires are used which are substantially uniform in cross section over their entire length. Such uniform cross section can be achieved by using precision drawing dies to produce the wires.

It is much more complicated to obtain a coating of emissive material of uniform thickness over the entire length and the entire circumference of the wire. The coating is performed by cataphoresis; by the use of a highly complex apparatus, an attempt is made to obtain a coating which is as uniform as possible over the entire length and circumference of the wire.

Thus, as is disclosed in DE-OS No. 27 15 242 mentioned above, the wire to be coated is disposed along the axis of a cylindrical coating vessel and surrounded concentrically by a cylindrical counterelectrode. Furthermore, the coating vessel in this coating process is rotated continuously, thus requiring slip ring contacts for the current supply.

Obviously, however, none of these means is sufficient to achieve a perfectly uniform coating over the entire surface of the wire. Apparently, the coating thickness is influenced not only by the coating apparatus, but also by the texture and the surface properties of the wires. An attempt has been made to overcome this disadvantage by subjecting the wires to a pretreatment, particularly to a complex cleaning operation, prior to the coating process. Even by these means, it has not been possible to completely correct diviations in the coating behavior.

SUMMARY OF THE INVENTION

It is the object of the invention to provide a method by which a uniform coating is achieved.

This object is achieved by coating wires in a suspension of emissive material in an electrolyte, said suspension containing diethyl carbonate, diethyl oxalate, ethyl alcohol, acetone and methanol. At the beginning of the coating process, the wire is connected as an anode for a short time, such as a fraction of a second to a few seconds. Immediately thereafter the coating is performed in the usual manner in the same suspension with the wire connected as a cathode. A counterelectrode of stainless steel is used and preferably the wires to be coated are subjected to a pretreatment consisting of washing and reductive annealing.

Surprisingly, it has become apparent that a substantially uniform coating of the wires in the production of oxide cathodes can be achieved by cataphoretic coating in a simple manner by connecting the wire to be coated as an anode for a short time at the beginning of the coating process.

DESCRIPTION OF THE DRAWING

Details of the invention and its advantageous features will now be explained with reference to the accompanying drawing which is a schematic representation of an apparatus for cataphoretic coating to produce oxide cathode wires.

DESCRIPTION OF THE PREFERRED EMBODIMENT

A tungsten wire is used here which has a substantially uniform cross section over its entire length. Instead of tungsten, a wire of molybdenum, cobalt, nickel or of alloys of these metals may also be used.

The wire 4 to be coated is held in a holder 3 which is disposed within a coating vessel 1. Preferably, the wire is held taut in the holder 3 by means of a device (not shown). A counterelectrode 5 is disposed opposite and parallel to the wire. It has been found advantageous in the method according to the invention to use a counterelectrode of a stainless steel, for example V2A steel.

The vessel 1 contains a suspension 2 of the emissive material. Preferably, mixtures of barium carbonate, strontium carbonate, and calcium carbonate, or mixed crystals of these carbonates, are used as emissive material. The emissive material is suspended in a suitable electrolyte. In the method according to the invention, it has been found advantageous to use a suspension which contains diethyl carbonate, diethyl oxalate, ethyl alcohol, acetone and methanol. The suspension is homogenized by a stirring device 6.

In the embodiment shown, a large number of wires can be present at the same time and be coated in the coating vessel 1. Thus, all wires are subject to the same conditions and are coated in the same manner. This is an advantage if all wires coated at the same time are used together in a picture-reproducing device.

The coating is performed at a d.c. voltage of 50 to 150 V, which is supplied by a current source 7. The coating current is checked by an ammeter 8.

Via a switch 9, the coating current is switched on for a predetermined period which can last up to 30 seconds and depends on the voltage of the current source 7, the desired coating thickness and the other apparatus and process parameters.

In accordance with the invention at the beginning of the coating process, the wire 4 is connected as an anode for a short time after which the direction of current flow is reversed. To this end, a polarity-reversing device 10 is provided. In the normal cathode coating process, the polarity-reversing device 10 has the switch position shown in the drawing in solid lines. However, in the method of the present invention at the beginning of the coating process, the polarity-reversing device 10 has the switch position shown in the drawing in broken lines, so that the wire 4 is connected as an anode.

In the coating process in accordance with the invention, the switch 9 is closed, and at the same time, the polarity-reversing device is switched to the position shown in the drawing in broken lines. After a short time, the polarity-reversing device 10 is switched to the position shown in the drawing in solid lines, the normal cathode coating process thus taking place. The coating process is concluded when the switch 9 is opened.

The switch 9 and the polarity-reversing device 10 can be combined in a single device.

The wire 4 to be coated is connected as an anode for only a short time, i.e., in most cases, fractions of a second to a few seconds will be sufficient.

Prior to the coating process, it is advantageous to subject the wires to a pretreatment consisting of washing and reductive annealing.

The method according to the invention has so far been described for the production of directly heated oxide cathode wires. However, it can also be used to advantage for depositing the emissive material if indirectly heated cathodes are produced.

What is claimed is:

1. A method of coating cathode wires by cataphorectically coating wires with an emissive material suspended in an electrolyte, comprising the steps of:

suspending a wire in a suspension of emissive material in an electrolyte;

connecting the wire as an anode for about a fraction of a second to about a few seconds; and thereafter connecting the wire as a cathode in the same suspension, whereby a uniform coating of the emissive material is cataphoretically coated on said wire.

2. A method as described in claim 1, wherein the electrolyte contains diethyl carbonate, diethyl oxalate, ethyl alcohol, acetone and methanol.

3. A method as described in claim 2, wherein a counterelectrode of stainless steel is used.

4. A method as described in claim 3, wherein the wires to be coated are subjected to a pretreatment consisting of washing and reductive annealing.

5. A method as described in claim 2, wherein the wires to be coated are subjected to a pretreatment consisting of washing and reductive annealing.

6. A method as described in claim 1, wherein a counterelectrode of stainless steel is used.

7. A method as described in claim 6, wherein the wires to be coated are subjected to a pretreatment consisting of washing and reductive annealing.

8. A method as described in claim 1, wherein the emissive material is selected from a group consisting of barium carbonate, strontium carbonate, calcium carbonate and mixtures thereof.

9. A method as described in claim 8, wherein a counterelectrode of stainless steel is used.

10. A method as described in claim 9, wherein the wires to be coated are subjected to a pretreatment consisting of washing and reductive annealing.

11. A method as described in claim 8, wherein the wires to be coated are subjected to a pretreatment consisting of washing and reductive annealing.

12. A method as described in claim 1, wherein the wires to be coated are subjected to a pretreatment consisting of washing and reductive annealing.

* * * * *